US007481146B2

(12) United States Patent
Weiss

(10) Patent No.: US 7,481,146 B2
(45) Date of Patent: Jan. 27, 2009

(54) DEVICE FOR DISRUPTING IMPROVISED EXPLOSIVE DEVICES (IEDS)

(76) Inventor: Peter Weiss, Immenweg 32, D-42279 Wuppertal (DE)

( * ) Notice: Subject to any disclaimer, the term of this patent is extended or adjusted under 35 U.S.C. 154(b) by 0 days.

(21) Appl. No.: 11/716,194

(22) Filed: Mar. 9, 2007

(65) Prior Publication Data

US 2008/0011152 A1 Jan. 17, 2008

(30) Foreign Application Priority Data

Jul. 11, 2006 (DE) ..... 10 2006 032 300

(51) Int. Cl.
*F41A 21/00* (2006.01)
*F41A 25/02* (2006.01)
*F42B 33/00* (2006.01)

(52) U.S. Cl. ..... 89/14.3; 42/1.06; 89/43.01; 86/50; 102/293; 102/430

(58) Field of Classification Search ..... 86/50; 102/430, 437, 440, 399, 439, 293; 42/1.11, 42/1.14, 1.06, 106; 89/42.01, 43.01, 1.11, 89/1.13, 1.14, 14.3
See application file for complete search history.

(56) References Cited

U.S. PATENT DOCUMENTS 3,003,418 A * 10/1961 Young ..... 102/436
3,037,454 A * 6/1962 Young ..... 102/439
4,169,403 A * 10/1979 Hanson ..... 86/50
4,779,511 A * 10/1988 Proctor et al. ..... 86/50
4,957,027 A * 9/1990 Cherry ..... 89/1.14
5,134,921 A * 8/1992 Breed et al. ..... 86/50
5,136,920 A * 8/1992 Breed et al. ..... 86/50
5,210,368 A * 5/1993 Heller et al. ..... 86/50
5,515,767 A * 5/1996 Gilbert ..... 89/1.701
5,743,246 A * 4/1998 Mattern ..... 124/56
5,824,944 A * 10/1998 Dippold et al. ..... 102/439
6,212,990 B1 * 4/2001 Elspass ..... 89/28.1
6,408,731 B1 6/2002 Elsener
6,490,957 B1 * 12/2002 Alexander et al. ..... 86/50
7,299,735 B2 * 11/2007 Alford ..... 89/1.13

FOREIGN PATENT DOCUMENTS

DE 32 36 285 10/1983
DE 195 00 417 7/1996
DE 198 04 652 8/1999

OTHER PUBLICATIONS

Derwents abstract of DE 32 36 285 A1, Oct. 1983.*
Derwents Abstract of DE 198 04 652 A1, Aug. 1999.*
Derwents Abstract of 195 00 417 A1, Jul. 1996.*

* cited by examiner

*Primary Examiner*—James S Bergin
(74) *Attorney, Agent, or Firm*—Friedrich Kueffner

(57) ABSTRACT

A device for disrupting improvised explosive devices (IEDs) with a projectile, which serves to penetrate and/or destroy at least part of the IED. In addition, an accelerator is provided, which accelerates the projectile when the device is actuated and propels it through a barrel. The accelerator is a cartridge filled with propellant. The cartridge is stored in a magazine and contains an initiator for initiating the acceleration. A primer, which is located at the base of the cartridge, serves as the initiator. Initiation occurs when the primer is struck by a firing pin.

12 Claims, 3 Drawing Sheets

DEVICE FOR DISRUPTING IMPROVISED EXPLOSIVE DEVICES (IEDS)

BACKGROUND OF THE INVENTION

1. Field of the Invention

The present invention relates to a device for disrupting improvised explosive devices (IEDs).

2. Description of the Related Art

Devices of this type are used especially by police forces and military forces and, in general, for disrupting explosive charges, bombs, and the like. They are used to penetrate the dangerous object, often in the area of the detonator mechanism, and destroy it by low-energy means, so that the explosive or incendiary charge is not detonated.

Previously known devices of this type have an accelerator in the form of an electrically fired cartridge. However, a problem that is encountered here is the safety of these cartridges with respect to electromagnetic compatibility (EMC). Unintentional firing, which can be caused, for example, by electromagnetic fields or pulses, must be absolutely prevented. Therefore, EMC safety is absolutely necessary for transporting cartridges by air, for example, to reach as fast as possible a destination where an IED must be disrupted. However, the transportation of the cartridges normally must continue by land, precisely because of a lack of EMC safety, while the disruptor is being carried by air, e.g., by helicopter, with the rest of the equipment, to the destination where the IED must be disrupted. The storage and shipping of the cartridges also present problems, especially when the sites of production, storage, and use are far apart, for example, on different continents. The cartridges must then be declared as special hazardous material and are also subject to complicated customs regulations.

SUMMARY OF THE INVENTION

Therefore, it is the object of the present application to optimize the accelerator in a device of the type discussed above in such a way that EMC safety is ensured and the cartridges are thus easier to store and ship.

In accordance with the present invention, a primer is located at the base of the cartridge. It acts as an initiator that starts the accelerator. Initiation occurs when the primer is struck by a firing pin. This greatly increases the EMC safety of the device and of the accelerator, so that nothing stands in the way of air transport, including, for example, helicopter transport. This makes it possible to ship the device and the accelerator quickly and directly to the site where it is to be used. There are also far fewer problems with the storage of the cartridges, since the danger of unintentional firing by electric fields is eliminated.

Either a water projectile or a plaster slug can be used as the projectile. Both are useful for the low-energy destruction of, for example, the igniter. Water projectiles have proven especially effective. To ensure that such a projectile keeps its shape for a longer period of time after the acceleration, a commercially available bag can be filled with the water and then guided into the device. This increases the effectiveness of the projectile.

Since the device must be loaded with the projectile and the cartridge before each use, it is advantageous for the magazine in which the cartridge is stored to be closed with a bayonet catch. This allows simple handling during the loading operation, and a possible reloading can also be carried out quickly and reliably. In addition, the number of components required for the loading operation is minimized, which also makes handling easier.

It is especially advisable that the bayonet catch be secured in its locked position by spring-loaded pins. In this way, it is always securely locked, and even if it is dropped or subjected to some other form of mechanical stress, the danger of the bayonet catch being released is minimized.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

Further advantages and embodiments of the invention are shown in the drawings and are specified in the dependent claims and the following description.

DETAILED DESCRIPTION OF THE INVENTION

Figure 1:
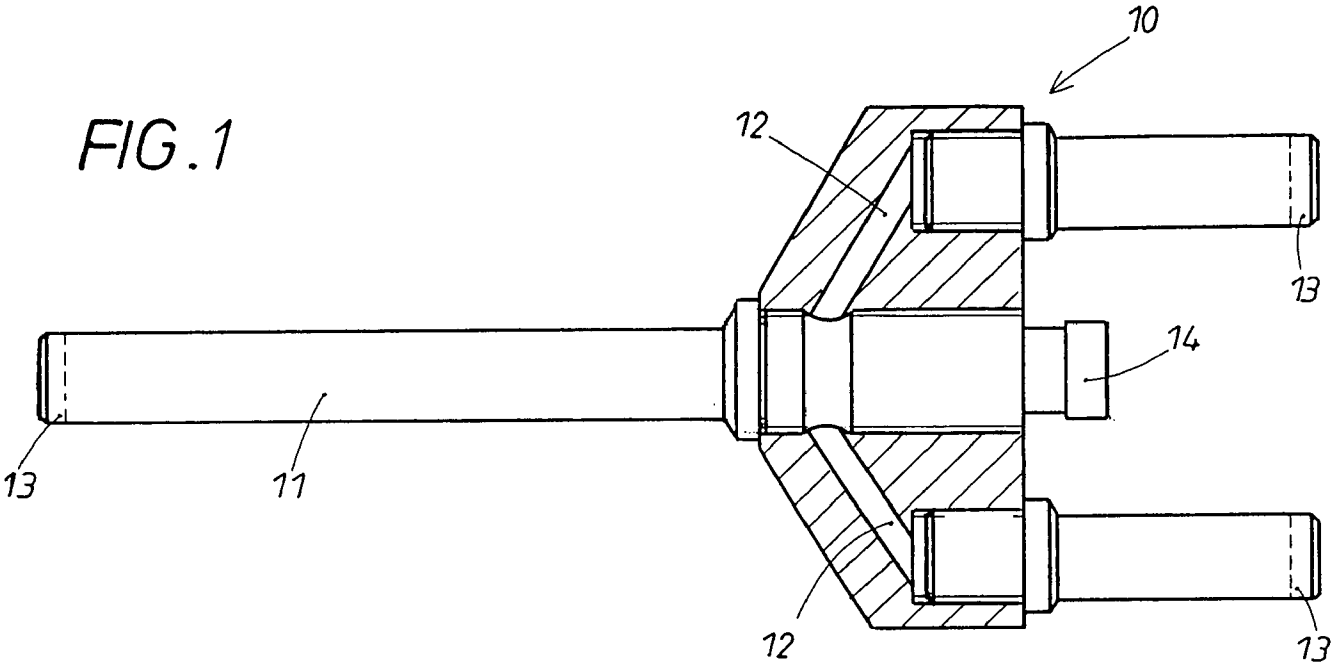
FIG. 1 shows an embodiment of the device of the invention in a partial section.

FIG. 1 shows a device 10 in accordance with the invention in partial section. Clearly shown are the barrel 11 and the two compensating tubes 12, which serve to compensate the recoil caused by the acceleration of the projectile. Both the barrel 11 and the ends of the compensating tubes 12 are closed with light plastic plugs 13. Due to the light-weight construction of these plastic plugs 13, there is no danger of damage or injury when they fly out during the acceleration of the projectile. The device 10 in FIG. 1 is shown without the accelerator 20.

Figure 2:
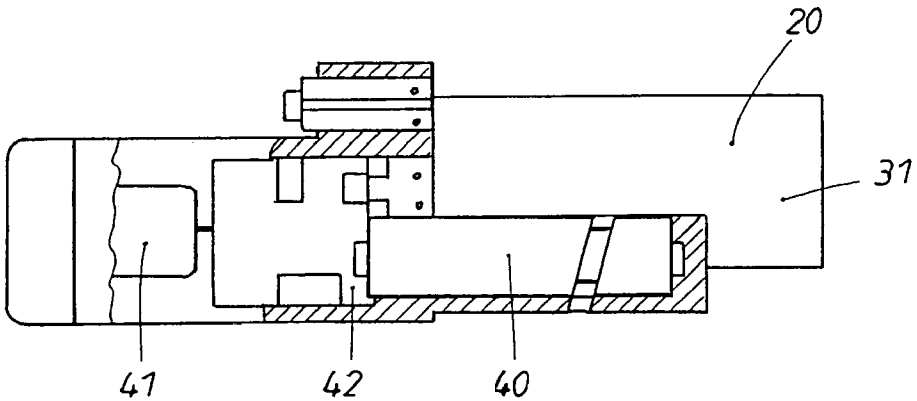
FIG. 2 is a detail drawing of a first embodiment of an accelerator in partial section.

FIG. 2 shows a first preferred embodiment of an accelerator 20. The firing pin, which is not shown in detail here, is spring-loaded in its inactive state before initiation and can be moved by means of a cam disk 40. The cam disk 40 is driven by an electric motor 41 and a gear drive 42. If the cam disk 40 is moved, the firing pin moves along with it and, due to the spring loading, accelerates abruptly towards the base 22 of the cartridge 21, as will be explained in greater detail later. If the cam disk 40 is driven in a complete revolution, then the firing pin arrives back in its well-defined starting position at the end of the complete revolution. This is especially advantageous, since the device 10 is then quickly ready for use again, and the firing pin is always secured in its well-defined spring-loaded position.

In addition, the device 10 has a connection point 14, at which a mating connection point 31 of the accelerator 20 can be connected.

Figure 3:
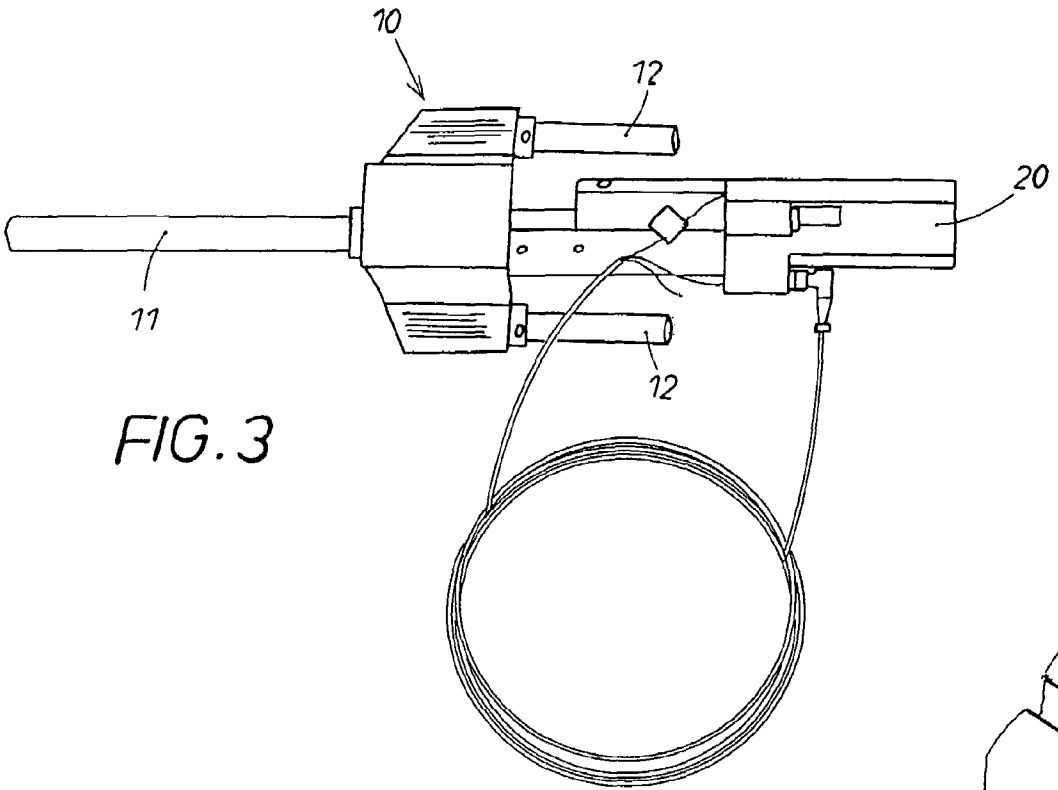
FIG. 3 shows the assembly of the parts in FIG. 1 and FIG. 2.

FIG. 3 shows the device 10 from FIG. 1 and the accelerator 20 from FIG. 2 in their assembled state. The drawing also reveals an electric connecting cable, which is necessary for the operation of the electric motor 41. The connection point 14 is connected to the connection point 31. The outlets of the two compensating tubes 12 can also be seen.

Figure 4:
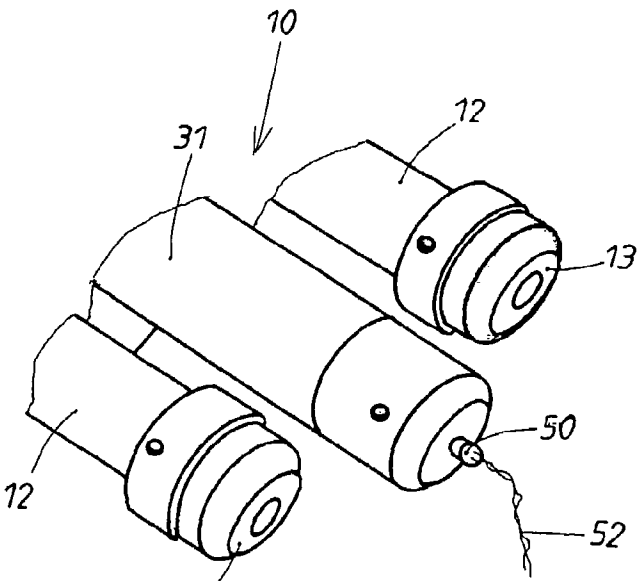
FIG. 4 is a detail drawing of a second embodiment of an accelerator.

FIG. 4 shows an alternative embodiment of the accelerator. The mating connection point 31 is also evident here. However, a bridge igniter 50 is used as the accelerator and can be recognized by the cables of the primer 52. The compensating tubes 12 with their plastic plugs 13 are also shown again. This version of the accelerator is advantageous especially for police applications.

Figure 5:
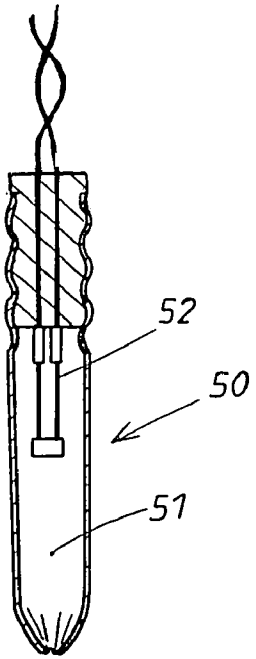
FIG. 5 shows a bridge igniter in section.

The bridge igniter 50 is shown again in greater detail in FIG. 5. Here it contains a propellant charge 51 and a primer 52. Although this propellant charge 51 is also ignited by electrical means, it is very small, so that it is very unlikely that problems with electromagnetic compatibility could arise. In a preferred embodiment, a propellant charge of 0.04 grams is used. In addition, when the propellant charges are being delivered, it is advisable first to deliver only the shell with primer and to keep the propellant charge itself separate. The propellant can then be introduced into the shell, and the shell can be closed at its upper end by bending it over. This eliminates any possible lingering objections related to electromagnetic compatibility.

Figure 6:
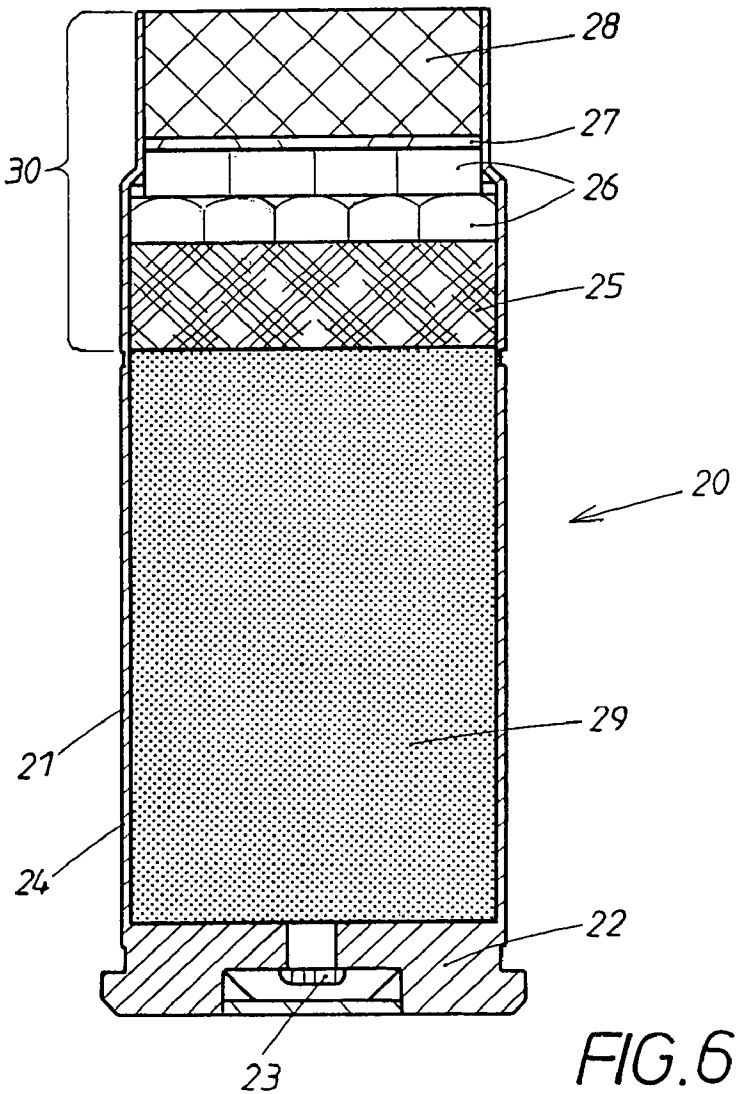
FIG. 6 shows a cartridge in section.

FIG. 6 shows an example of a cartridge. It is especially advantageous to use a commercial cartridge case 24 without a projectile. These cartridge cases are simple and can be purchased inexpensively. The primer 23, which acts as the initiator of the accelerator 20, is located at the base 22 of the cartridge 21. The cartridge 21 is sealed at its upper end 30. In the present case, the seal is created by inserting first a felt disk 25, followed by two layers of corrugated board 26. This is followed by a layer of coated paper 27, which is constructed much like impregnated cardboard. Finally, wax is poured into the cartridge 21 to form a wax plug 28, which tightly seals the whole cartridge 21.

The device 10 should be designed in such a way that a commercial cartridge case 24 without a projectile can be used, but at the same time in such a way that a commercial cartridge case with a projectile cannot be fired with the device.

To compensate the recoil, the compensating tubes 12 are operated with water. If the device 10 is used at temperatures below 0° C., it is useful, when a water projectile is being used, to add antifreeze solutions to the water or to use antifreeze solutions for the projectile and the compensating tubes 12 alike.

It should be noted that the embodiments illustrated here are merely examples of the invention. The invention is not limited to these examples, but rather various other embodiments and modifications are possible. For example, the design of the cartridge case and of the bridge igniter can vary. The cam disk can also be of a different form. The form of the device itself is not fixed, either. It is also possible to use other accelerators which strike the primer.

I claim:

1. A device for disrupting improvised explosive devices (IEDs), the device comprising: a barrel; a firing pin; a firing pin mechanism; a projectile, which serves to penetrate and/or destroy at least part of the IED; and an accelerator, which, when the device is actuated, accelerates the projectile and propels it through the barrel, wherein the accelerator is designed as a cartridge filled with propellant, and the cartridge is stored in a magazine and contains an initiator for initiating the acceleration, wherein a primer at the base of the cartridge serves as the initiator and that initiation occurs when the primer is struck by the firing pin: and one or more compensating tubes, which are operated with water and compensate the recoil of the device upon initiation.

2. A device in accordance with claim 1, wherein the projectile is a water projectile.

3. A device in accordance with claim 2, wherein the water projectile is enclosed in a bag.

4. A device in accordance with claim 1, wherein a plaster slug is used as the projectile.

5. A device in accordance with claim 1, wherein the firing pin is spring-loaded in its inactive state before initiation.

6. A device in accordance with claim 1, wherein the firing pin is moved by a cam disk, which is moved during initiation and accelerates the firing pin towards the base of the cartridge.

7. A device in accordance with claim 6, wherein the cam disk is moved by an electric motor, especially by means of a gear drive connected between them.

8. A device in accordance with claim 1, wherein, during initiation, the firing pin is accelerated by a bridge igniter towards the base of the cartridge.

9. A device in accordance with claim 8, wherein the bridge igniter contains a propellant charge of 0.04 g which is electrically ignited.

10. A device in accordance with claim 1, wherein a commercial cartridge case is used as the cartridge.

11. A device in accordance with claim 1, wherein the cartridge is sealed at its upper end with one or more layers of felt, corrugated board, coated paper, and/or wax.

12. A device in accordance with claim 1, wherein the barrel and/or the compensating tubes are closed with light plastic plugs.

* * * * *